US007370958B2

(12) United States Patent
Lee

(10) Patent No.: US 7,370,958 B2
(45) Date of Patent: May 13, 2008

(54) MULTI PURPOSE DIGITAL PRINTER

(75) Inventor: Kilhun Lee, Seoul (KR)

(73) Assignee: Taeil Systems Co., Ltd., Seoul (KR)

( * ) Notice: Subject to any disclaimer, the term of this patent is extended or adjusted under 35 U.S.C. 154(b) by 48 days.

(21) Appl. No.: 10/570,978

(22) PCT Filed: Aug. 18, 2004

(86) PCT No.: PCT/KR2004/002062

§ 371 (c)(1),
(2), (4) Date: Mar. 29, 2006

(87) PCT Pub. No.: WO2005/023551

PCT Pub. Date: Mar. 17, 2005

(65) Prior Publication Data

US 2006/0192830 A1 Aug. 31, 2006

(30) Foreign Application Priority Data

Sep. 8, 2003 (KR) ..... 10-2003-0062720

(51) Int. Cl.
*B41J 2/01* (2006.01)

(52) U.S. Cl. ..... 347/104; 347/101; 347/102; 347/8

(58) Field of Classification Search ..... 347/101, 347/102, 104, 8
See application file for complete search history.

(56) References Cited

U.S. PATENT DOCUMENTS

| | | | | |
|---|---|---|---|---|
| 5,764,264 | A * | 6/1998 | Takanaka | 347/104 |
| 5,867,197 | A * | 2/1999 | Aoki | 347/106 |
| 6,074,054 | A * | 6/2000 | Katsuyama | 347/104 |
| 6,511,152 | B2 * | 1/2003 | Yoshimura | 347/33 |
| 6,561,607 | B1 * | 5/2003 | Lubinsky et al. | 347/8 |
| 6,634,744 | B2 * | 10/2003 | Yamamoto et al. | 347/104 |
| 6,851,777 | B2 * | 2/2005 | Speckhart | 347/8 |

FOREIGN PATENT DOCUMENTS

| | | | |
|---|---|---|---|
| JP | 6-56354 | | 3/1994 |
| JP | 06056354 | * | 3/1994 |
| JP | 11192694 | * | 7/1999 |
| JP | 2001-122486 | | 5/2001 |
| JP | 2001-206574 | | 7/2001 |
| JP | 2001-277656 | | 10/2001 |

* cited by examiner

*Primary Examiner*—Matthew Luu
*Assistant Examiner*—Joshua M Dubnow
(74) *Attorney, Agent, or Firm*—Jordan and Hamburg LLP

(57) ABSTRACT

The present invention discloses a multi-purpose digital printer having a transfer roller making very thin or retractable printing material move while adhering to an adhesive on the transfer belt, to prevent twisting or wrinkling, and extension states of the printing material, so that it is possible to print not only on very thin or retractable printing material, but also on unfixed form, type or thick printing material.

6 Claims, 7 Drawing Sheets

Related Art

Related Art

MULTI PURPOSE DIGITAL PRINTER

BACKGROUND OF THE INVENTION

1. Field of the Invention

The present invention relates to a multi-purpose digital printer, and more particularly a printing machine with a transfer roller performing effectively textile-printing operations not only to the very thin and retractable printing materials, but also to the very thick and unfixed form or type of special materials.

2. Description of the Related Art

Generally, in the conventional printing machine utilizing a technique of subtractive mixture, a digital controller sends digitalized signals to a head of the printing machine, so that the head may inject proper amounts of ink of three primary colors comprising magenta, yellow, and cyan, and of a black color to a printing material to produce various color tones. Therefore, the latest printing machine makes it possible for a user to design more easily what she/he wants.

In the technique of subtractive mixture, the head of the printing machine equips several ink reservoirs, while each ink reservoir contains one color respectively. The head injects proper amounts of ink from each reservoir to produce a new color tone. The head often equips another ink reservoir containing special color to produce a new color tone, if necessary.

By referencing FIG. 1 and FIG. 2, the conventional printing machine will be described in the following statements.

The conventional printing machine equips a transfer belt 5 with a rail shape on the top of a base 3, while the base 3 is supported by both legs 1 contacting with the ground. A cartridge 9 is fixed with the transfer belt 5, so that a head 7 of the cartridge 9 can be moved through the transfer belt 5. Additionally, a transfer axis 50 is connected with a transfer motor (not shown) within a driving panel 18 included in the one side of the inner upper side of the base 3. Additionally, lots of transfer rollers 51 on the transfer axis 50 protrude from the top of the base 3 to make a printing material 17 move in the forward direction, while a press roller 40 placed correspondingly on the top of each transfer roller 51 presses down on the printing material 17.

Additionally, a feeding roller 11 included in the rear side of the digital printing machine supplies the printing material 17 to the top of the base 3. When the cartridge 9 moves reciprocally to the left or the right direction on the top of the printing material 17, the head 7 moving in combination with the cartridge 9 injects predetermined amounts of each color from the corresponding ink reservoir to perform printing operations. The printed material is then recoiled in a rewinding roller 12 located on the opposite side of the feeding roller 11.

An operation panel 16 covered by a cover 15 is equipped on the top of the base 3. Therefore, a user can input any desirable signal to be printed in the printing material 17.

However, the conventional printing machine described in the above statements has the following problems. After the printing material 17 is put between lots of transfer rollers 51 and press rollers 40, the transfer roller 51 rotates to make the printing material 17 move to the front side of the base 3. When the printing material 17 is extremely thin in the case of textile printing, the speed of the printing material 17 passing through between the transfer rollers 51 and the press rollers 40 is different from that of the printing material 17 before the transfer roller 51. Therefore, a portion of the printing material 17 is often wrinkled causing the printing colors to overlap, resulting in a higher percentage of defective printing operations, or is extended too much, causing the printing design to be distorted.

DETAILED DESCRIPTION OF THE INVENTION

To overcome the above described problems, the present invention discloses a multi-purpose digital printer with a transfer roller, making the very thin and flexible printing material move on a transfer belt coated with adhesive to prevent twisted, wrinkled, or extended states of the printing material.

Additionally the present invention provides a printing machine elevating up and down a head on a base to a predetermined height to print not only the very thin and flexible material, but also the very thick and unfixed form or type of special materials.

To achieve the above described purpose, the present invention discloses A multi-purpose digital printer comprising: a main body with a predetermined height and width; a head unit including a cartridge moving horizontally according to the direction of the main body, and a head at the one side of the cartridge injecting ink to print on a printing material supplied from the rear of the main body; a transfer means including front and rear transfer rollers coupled with a transfer motor in the front and the rear of the main body respectively, and a track laying and adhesive transfer belt connecting the front and the rear transfer rollers making the printing material movement stable; a rear transfer means including a rear bobbin axis having a bobbin wound with the printing material in the rear of the main body, and multiple rear rollers at a predetermined position adjacent to the rear bobbin axis transferring the printing material to the forward direction stably; a front transfer means at the front of the main body, winding the printing material past the transfer belt by the rear transfer means to a front bobbin axis; a washing means eliminating the residues of the injected ink of the transfer belt and adhered foreign substances by rotation of a roller brush driven by a motor of the main body; and a belt heater of a predetermined position at the bottom of the main body eliminating moisture and maintaining the sticky state of the transfer belt passing through the washing means.

Additionally, the front transfer means comprises two position sensors installed at a predetermined distance from the bottom of the front transfer roller; and a winding motor at the one side of the front bobbin axis, receiving signals from the position sensors to rotate the front bobbin axis to wind the printing material.

Additionally, the washing means comprises a washing tub under the transfer belt, receiving washing water from the outside; a roller brush inside the washing tub, adjacent to the transfer belt; and a cylinder at the bottom of the main body, capable of lifting up and down the washing tub.

Additionally, the multi-purpose digital printer further comprises a heater at the front of the main body to dry the printing material transferred to the front bobbin axis.

Additionally, the multi-purpose digital printer further comprises an elevating cylinder at both sides of the main body respectively, and a head on the top of a piston of the elevating cylinder to adjust a gap between the transfer belt and the head unit.

Additionally, the multi-purpose digital printer further comprises a press means on the top of the rear transfer roller, to press the printing material passing along the transfer belt at a predetermined pressure by using a roller, wherein the press means includes an operation link rotating at a predetermined angle by eccentric hinges installed on both sides of the main body; a handle operating the one end of the operation link; multiple fixing holes at the other operation link; multiple adjusting holes corresponding to the multiple fixing holes at the other operation link; a stopper passing through the adjusting hole of the main body and the corresponding fixing hole thereby joining the two together; and a roller rotatable at the two operation links.

Additionally, the multi-purpose digital printer further comprises a positioning means at the rear of the main body to prevent position deviation of the printing material, wherein the positioning means includes a left and right adjusting roller rotatable between both brackets of the main body; two rear position sensors at a predetermined position from the rear transfer means; and a cylinder receiving signals from one of the rear position sensors to lead the left and right adjusting roller to set the deviated printing material in the correct position.

DESCRIPTION OF THE DRAWINGS

For a more complete understanding of the present invention and the advantages thereof, reference is now made to the following descriptions taken in conjunction with the accompanying drawings, in which like reference numerals denote like parts, and in which.

EMBODIMENT

Reference will now be made in detail to preferred embodiments of the present invention, an example of which is illustrated in the accompanying drawings.

Figure 1:
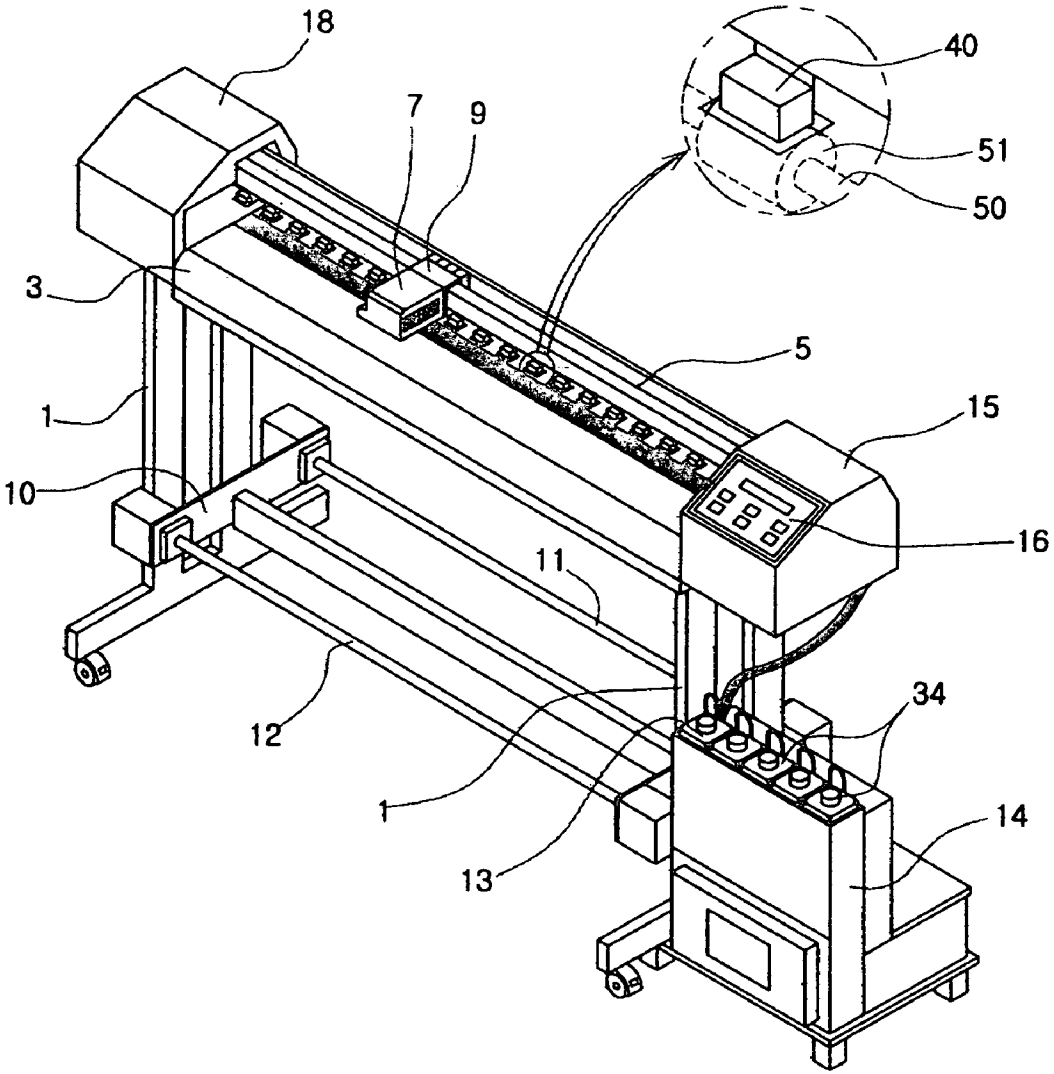
FIG. 1 is a perspective view of a conventional printing machine.
Figure 2:
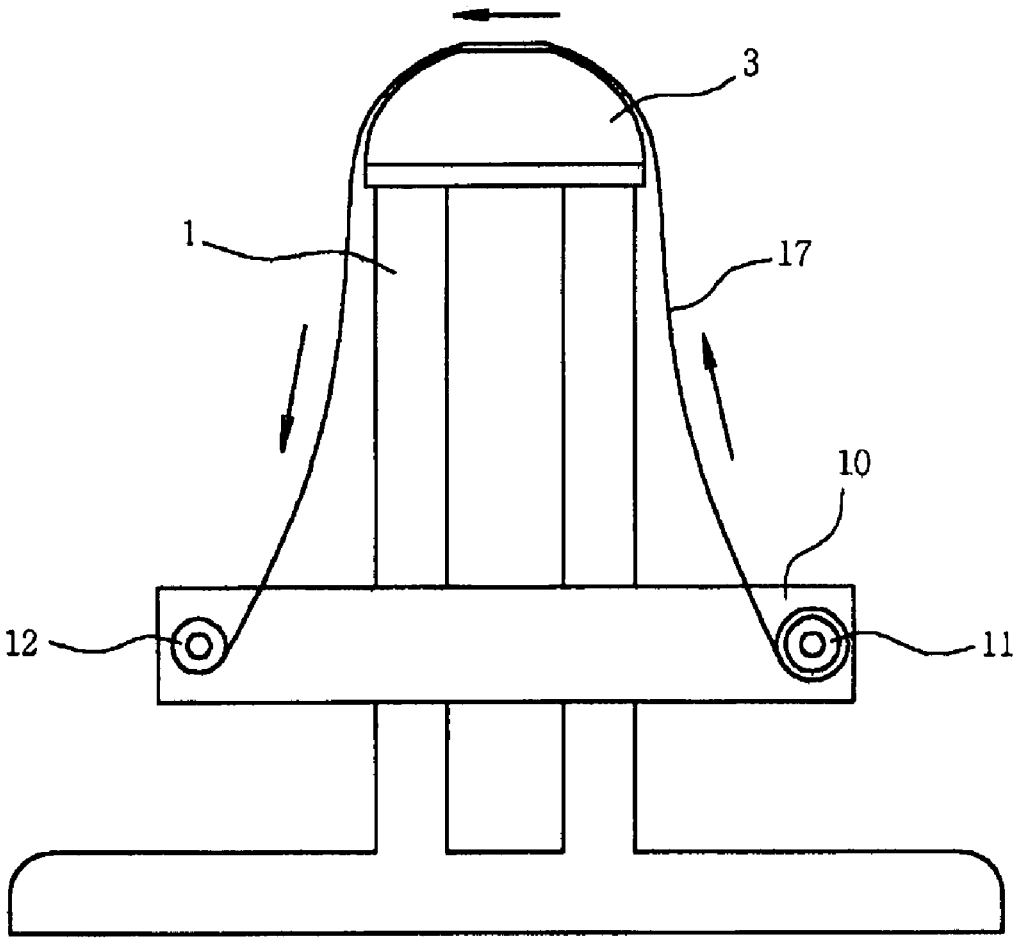
FIG. 2 is a schema of a printing machine illustrating transfers of a printing material according to FIG. 1.
Figure 3:
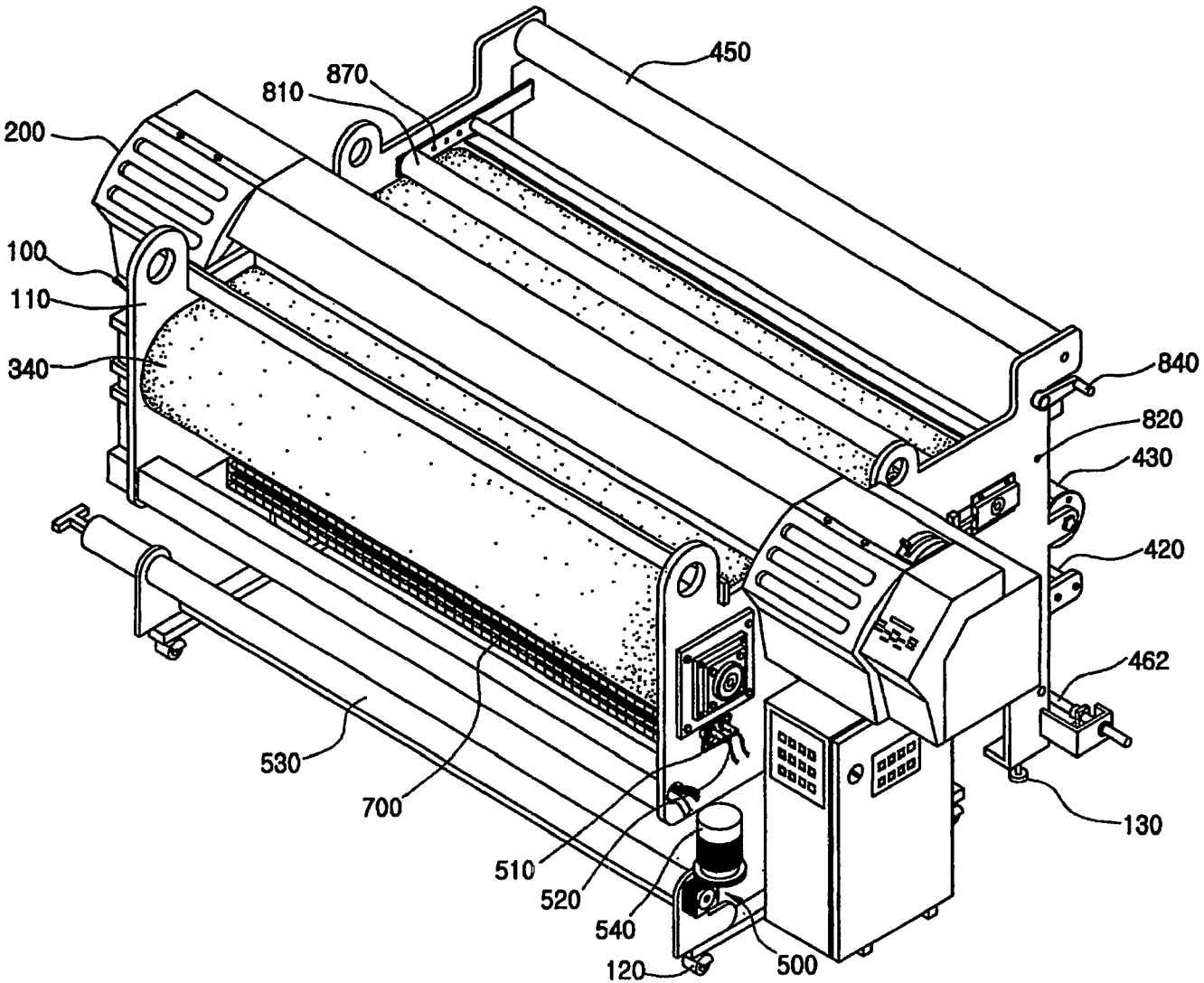
FIG. 3 is a front perspective view of a multi-purpose digital printer of the present invention.
Figure 4:
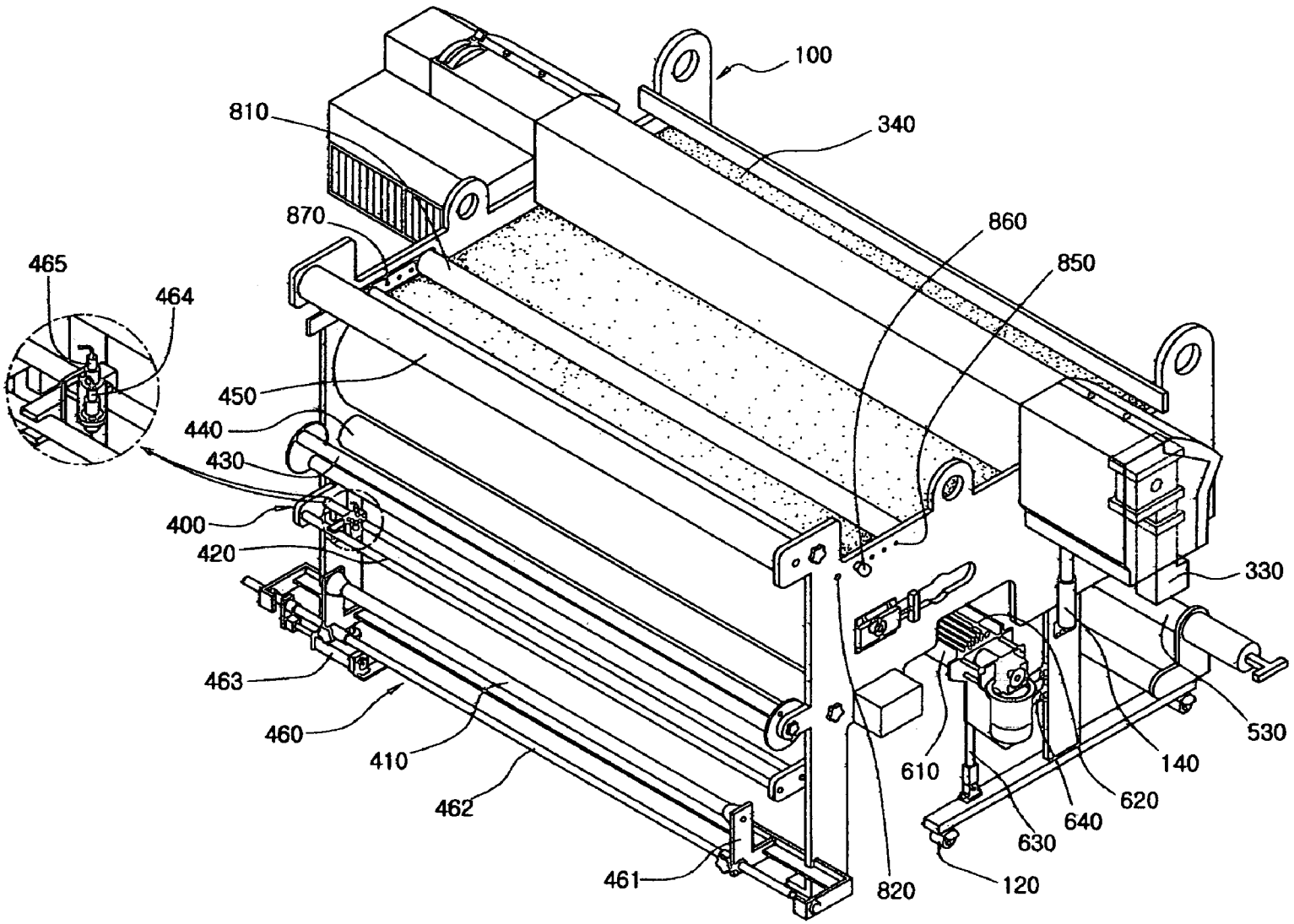
FIG. 4 is a rear perspective view of the multi-purpose digital printer of the present invention.
Figure 5:
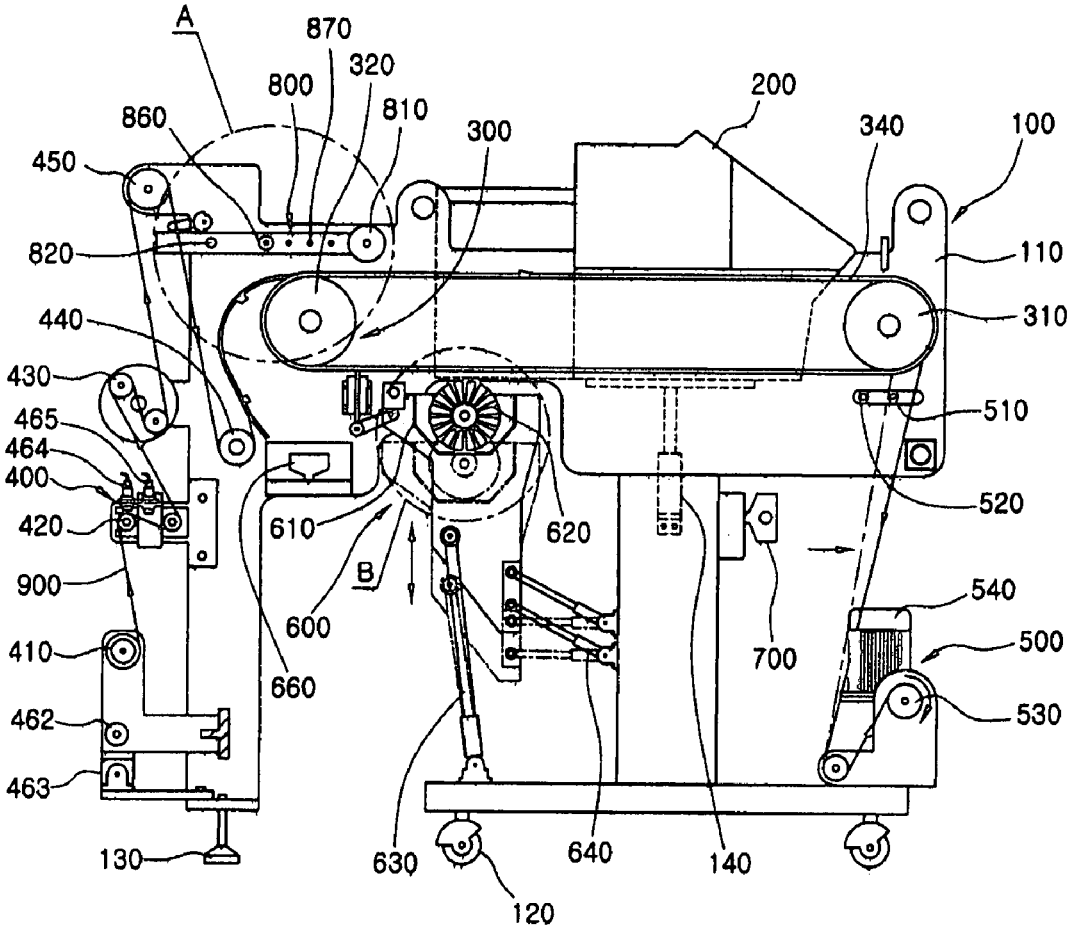
FIG. 5 is a cross sectional side view of the multi-purpose digital printer of the present invention.

FIG. 3 is a front perspective view; FIG. 4 is a rear perspective view; and FIG. 5 is a cross sectional side view of the multi-purpose digital printer according to the present invention.

In the printing machine according to the present invention, a supporting frame 110 is included in a predetermined height of the main body 100. Multiple casters 120 and stoppers 130 are included in the bottom area of the supporting frame 110.

The cartridge on the top of the main body 100 moves horizontally, and a head (not shown) on one side of the cartridge injects ink onto a printing material. Therefore, the head unit 200 comprising the cartridge and the head (not shown) performs printing operations on the printing material supplied from the backward direction.

A transfer means 300 of the main body 100 moving a printing material 900 to the forward direction comprises a front and a rear transfer rollers 310 and 320, installed in the front and the rear positions of the supporting frame 110 respectively, while the front transfer roller 310 is coupled with a transfer motor 330 shown in FIG. 4.

Additionally, a transfer means 300 includes a transfer belt 340 located between the front and the rear transfer rollers 310 and 320. The transfer belt 340 is a little thick and track type, and the surface of the transfer belt 340 is a rubber material coated by an adhesive. Therefore, it is possible for the very thin printing material 900 to be adhered to the surface of the transfer belt 340.

As shown in FIG. 4, the rear of the main body 100 of the printing machine includes a rear transfer means 400 sending the printing material 900 to the head unit 200. The rear transfer means 400 comprises a rear bobbin axis 410 having a bobbin wound with the printing material 900, and multiple rear rollers 420, 430, 440 and 450 making the printing material 900 move in the forward direction while unwinding the printing material 900.

Additionally, a positioning means 460 is installed in the rear of the main body 100 of the printing machine to prevent position deviation of the printing material 900. The positioning means 460 comprises two rear position sensors 464 and 465 installed on the left top of the rear transfer means 400. Therefore, the end of the left side of the printing material 900 is located between the two rear position sensors 464 and 465.

A bracket 461 of both sides of the main body 100 is fixed to a left and right adjusting roller 462. When the printing material 900 deviates from the position between the two rear position sensors 464 and 465, a cylinder 463 connected with the left and right adjusting roller 462 moves to one side to set the printing material 900 in the correct position.

In other words, when the printing material 900 positioned between both brackets 461 passes through the rollers of the rear transfer mean 400, the end of the printing material 900 is located in between the two rear position sensors 464 and 465 on the left top of the rear transfer means 400. Therefore, the left rear position sensor detects drift of the printing material 900 to the left direction, and the right rear position sensor detects drifts of the printing material 900 to the right direction. As a result, the cylinder 463 makes the left and right adjusting roller 462 move to the left or the right direction to prevent deviation of the printing material 900.

As shown in FIG. 3 and FIG. 5, the front of the main body 100 of the printing machine includes a front transfer means 500 winding the printing material 900 transferred from the rear of the main body 100. The front transfer means 500 comprises two front position sensors 510 and 520 set apart at a predetermined distance from the bottom of the front transfer roller 310 of the transfer means 300, and a winding motor 540 receiving signals of the front position sensors 510 and 520 to rotate the front bobbin axis 530 to wind the printing material 900.

In other words, the printing material 900 is transferred from the front transfer roller 310 of the transfer roller 300 in the adhered state because of adhesion of the front transfer roller 310. When the printing material 900 passing through the front position sensors 510 approaches the front position sensor 520, the front position sensor 520 drives the winding motor 540 to rotate the front bobbin axis 530. Therefore, the printing material 900 adhered to the front transfer roller 310 becomes separated from the front transfer roller 310.

Figure 6:
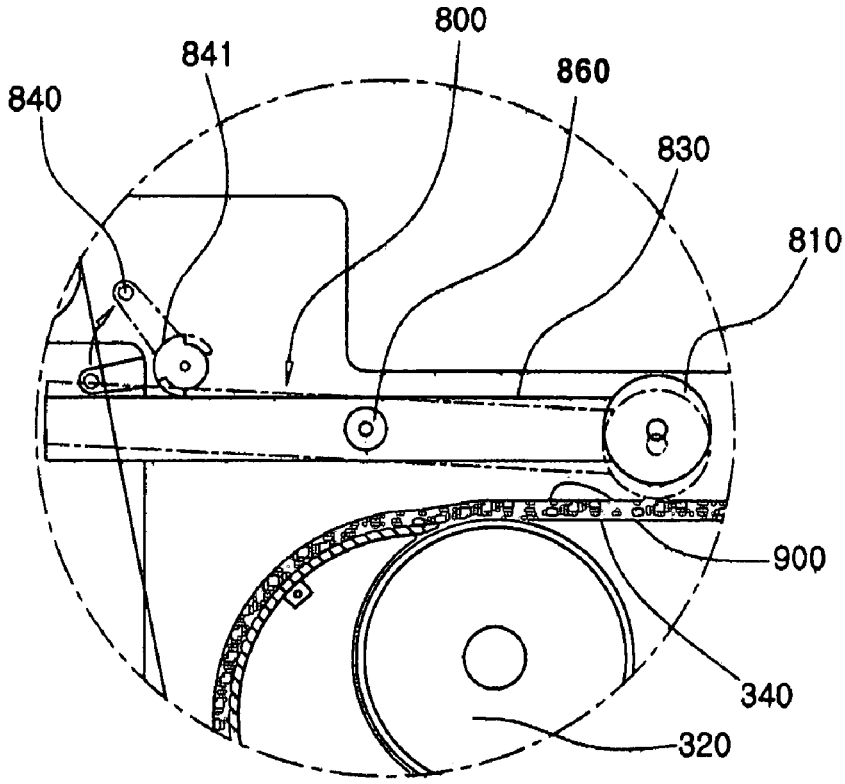
FIG. 6 is a cross sectional view enlarging a main part A of FIG. 5.

As shown in FIG. 4 and FIG. 6, the top of the rear transfer roller 320 of the transfer means 300 includes a roller 810 of a press means 800 pressing down on the printing material 900 passing through the transfer belt 340 at a predetermined pressure. An eccentric hinge 820 on both sides of the main body 100 of the printing machine makes an operation link 830 rotate in a predetermined angle. A driving handle 840 operates the one side of the operation link 830. The other side of the operation link 830 includes multiple fixing holes 870 corresponding to multiple adjusting holes 850 so that a stopper 860 passing through the multiple adjusting holes 85Q of the main body 100 are joined with the corresponding multiple fixing holes 870. Additionally, the ends of the two operation links 830 rotate the roller 810.

In this case, the one side of the handle 840 includes a cam protrusion 841 corresponding to the operation link 830. Therefore, when the handle 840 is rotated, the cam protrusion 841 utilizing the eccentric hinge 820 as a center of leverage lifts up the operation link 830 to adjust the gap between the transfer belt 340 and the roller 810.

Figure 7:
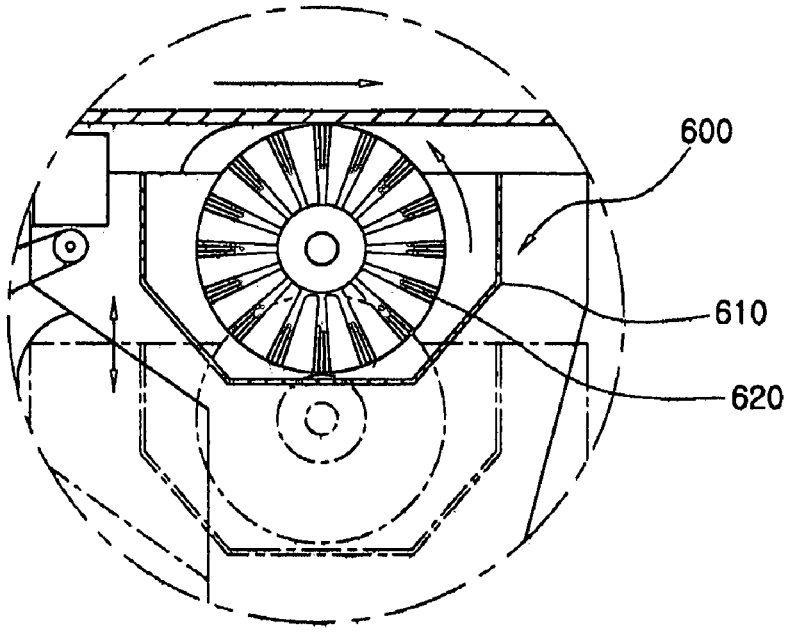
FIG. 7 is a cross sectional view enlarging a main part B of FIG. 5.
Figure 8:
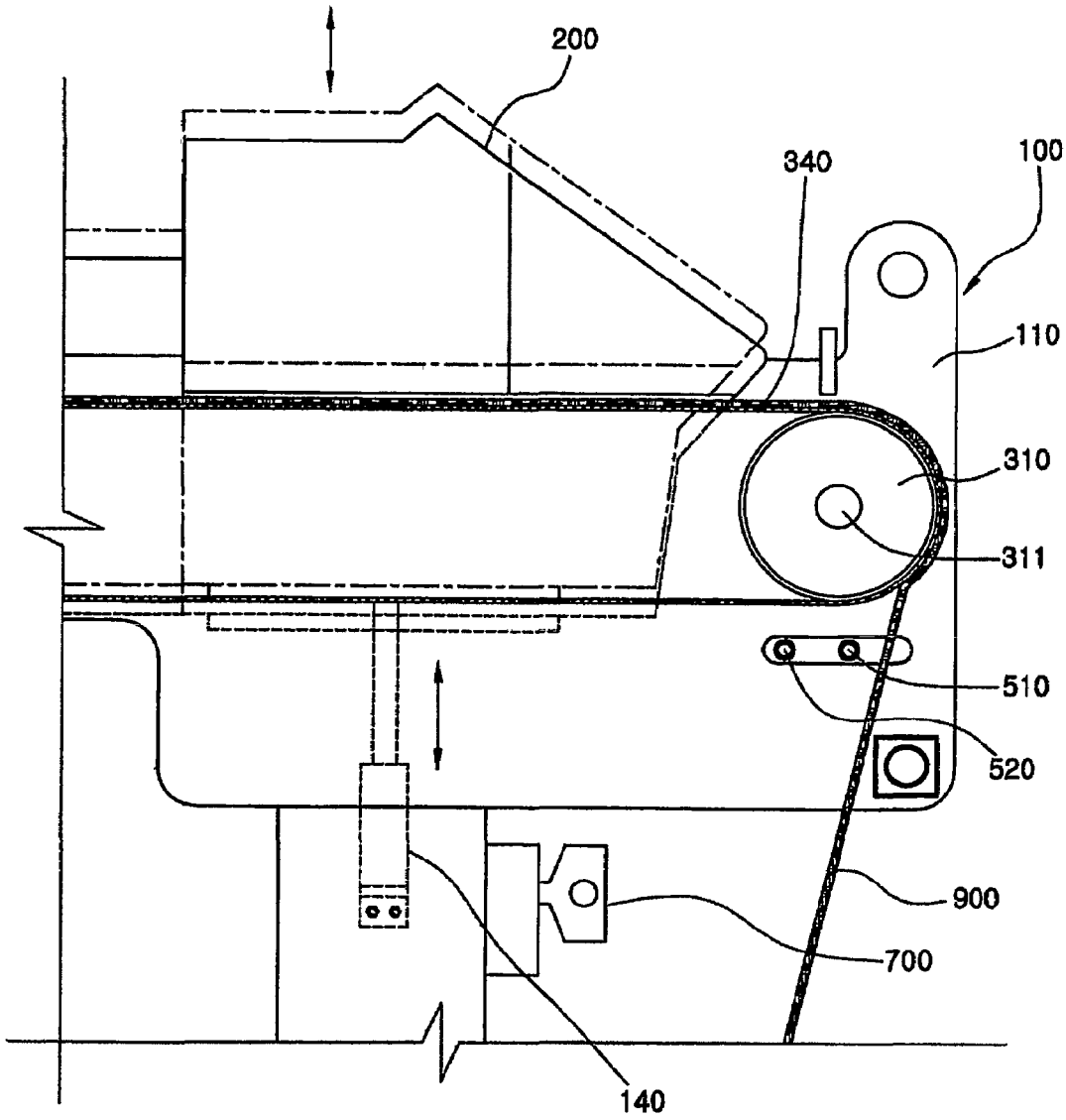
FIG. 8 is a cross sectional view describing elevating states of a head and a main body of a printing machine according to the present invention.

As shown in FIG. 5 and FIG. 7, the main body 100 of the printing machine includes a washing means 600 for eliminating the residues of the injected ink of the transfer belt 340, and adhered foreign substances. The washing means 600 comprises a washing tub 610 under of the transfer belt 340 for receiving washing water from the outside and supplying washing water to the transfer belt 340, a roller brush 620 on the inside of the washing tub 610 adjacent to the transfer belt 340, a cylinder 630 for lifting up and down the washing tub 610 to the bottom of the main body 100, and a guide cylinder 640 for stably leading the lifting of the washing tub 610.

In other words, when the transfer belt 34Q gets more foreign substances and the adhesiveness between the transfer belt 340 and the printing material 900 is lowered, a switch in the head unit 200 is operated to lift up the washing tub 610 by the supports of the guide of the cylinder 630 and the guide cylinder 640. Sequentially, the roller brush 620 approaches the bottom of the transfer belt 340, and a washing motor 650 makes the roller brush 620 rotate simultaneously. As a result, washing water from the roller brush 620 eliminates foreign substances on the transfer belt 340.

The bottom of the main body 100 of the printing machine includes a belt heater 660 in a proper position. The belt heater 660 eliminates moisture on the transfer belt 340 passing through the washing means 600 to keep the surface of the transfer belt 340 in dry. Additionally, the front of the main body 100 includes a heater 700 for drying the printing material 900 coming from the front bobbin axis 530.

Additionally, the head unit 200 is installed on the top of the piston of an elevating cylinder 140 after an elevating cylinder 140 is installed on both sides of the main body 100 of the printing machine respectively. Therefore, by adjusting the gap between the transfer belt 340 and the head unit 200, it is possible to print not only on very thin textile fabric, but also on an unfixed form or type of special material.

Operations and effects of the multi-purpose digital printer of the present invention will be described in the following statements.

As shown in the FIG. 5, the printing material 900 is installed on the rear bobbin axis 410 of the rear transfer means 400 of the main body 100 of the printing machine, and the printing material 900 is installed in the multiple rear rollers 420 to 450, sequentially. Therefore, the printing material 900 is installed on the transfer belt 340 of the transfer means 300. Meanwhile, the printing material 900 is connected with the front bobbin axis 530 installed in the front transfer means 500 of the front of the main body 100.

As shown in FIG. 4 and FIG. 6, after the printing material 900 is installed, the handle 840 of the press means 800 is rotated for the cam protrusion 841 to adjust the operation link 830, and the gap between the transfer belt 340 and the roller 810 is adjusted to fit the thickness of the printing material 900. After adjusting the gap between the transfer belt 340 and the roller 810, the stopper 860 is inserted into the adjusting hole 850 of the main body 100 and into the fixing hole 870 of the operation link 830 to constantly maintain the gap between the transfer belt 340 and the roller 840.

Sequentially, not only the transfer motor 330 of the transfer means 300 but also the head unit 200 is operated to perform printing operations. Because the printing material 900 is moved in the states of spreading and adhering to the transfer belt 340, it is possible to prevent very thin printing material 900 from twisting or wrinkling.

The printing material 900 completing printing operations after passing through the transfer belt 340, is dried by the heater 700 in the front of the main body 100, and wound onto the front bobbin axis 530 of the front transfer means 500.

When extremely thin printing material 900 is twisted, wrinkled or deviated from the correct position of the rear rollers 420 to 450, the cylinder 463 connected with the left and right adjusting roller 462, as shown in FIG. 4, moves to the side direction to set the printing material 900 to the correct position. In other words, while the printing material 900 installed in both brackets 461 is passing through the roller of the rear transfer means 400, the end of the printing material 900 is located between two rear position sensors 464 and 465 on the left top of the main body 100. Therefore, when the printing material 900 is moved to the left direction, the left position sensor 465 detects deviation of the printing material 900, and the cylinder 463 makes the printing material 900 move to the right direction. Similarly, when the printing material 900 is moved to the right direction, the right position sensor 464 detects deviation of the printing material 900, and the cylinder 463 makes the printing material 900 move to the left direction. As a result, twisting or wrinkling states of the printing material 900 is prevented.

To print to the unfixed form, type or thick printing material 900, the elevating cylinder 140 on both sides of the main body 100 is operated to widen the gap between the transfer belt 340 and the head unit 200. Therefore, it is possible to print not only on very thin textile fabric, but also on unfixed form, type or thick printing material.

When plenty of foreign substances such as dust, are adhered to the transfer belt 340, the switch on a control box is driven to lift up the washing tub 610 by the supports of the cylinder 630 and the guide cylinder 640, and to move the roller brush 620 close to the bottom of the transfer belt 340. At the same time, the washing motor 650 rotates the roller brush 620, and washing water of the roller brush 620 eliminates foreign substances on the transfer belt 340. Meanwhile, washing water containing foreign substances in the washing tub 610 is drained out to the outside and fresh washing water is supplied from the outside.

Additionally, the transfer belt 340 passing through the washing means 600 is dried by the belt heater 660 to maintain the surface of the transfer belt 340 in sticky state without any moisture. When the adhesiveness of the transfer belt 340 is greatly lowered even after the washing and drying process, the transfer belt 340 is re-coated with an adhesive.

The printing machine of the present invention having a transfer roller makes very thin or retractable printing material 900 move by adhering to an adhesive on the transfer belt 340. Therefore, it is possible to prevent twisting or wrinkling states, and also to prevent extension states of the printing material 900.

Additionally, the head unit 200 installed on the top of the main body 100 is lifted up to a predetermined height. Therefore, it is possible to print not only the very thin printing material 900, but also unfixed form, type or thick printing material 900.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A multi-purpose digital printer comprising:

a main body with a predetermined height and width;

a head unit including a cartridge moving horizontally according to the direction of the main body, and a head at the one side of the cartridge injecting ink to print on a printing material supplied from the rear of the main body;

a transfer means including a front and a rear transfer rollers coupled with a transfer motor in the front and the rear of the main body respectively, and a track laying and adhesive transfer belt connecting the front and the rear transfer rollers making the printing material movement stable;

a rear transfer means including a rear bobbin axis installing a bobbin wired by the printing material in the rear of the main body, and multiple rear rollers at a predetermined position adjacent to the rear bobbin axis stably transferring the printing material in the forward direction;

a front transfer means at the front of the main body, winding the printing material past the transfer belt by the rear transfer means to a front bobbin axis;

a washing means eliminating the residues of the injected ink of the transfer belt and adhered foreign substances by rotation of a roller brush driven by a motor of the main body;

a belt heater at a predetermined position on the bottom of the main body eliminating moisture and maintaining the sticky state of the transfer belt passing through the washing means; and a press means on the top of the rear transfer roller, to press the printing material passing though the transfer belt in a predetermined pressure by using a roller, wherein the press means includes:

an operation link rotating in a predetermined angle by eccentric hinges installed on both sides of the main body;

a handle operating the one end of the operation link;

multiple fixing holes at the other operation link;

multiple adjusting holes corresponding to the multiple fixing holes at the other operation link;

a stopper passing through the adjusting hole of the main body joins the adjusting hole with the corresponding fixing hole; and a roller rotatable at the two operation links.

2. The multi-purpose digital printer according to claim 1, wherein the front transfer means comprises:

two position sensors installed at a predetermined distance from the bottom of the front transfer roller; and a winding motor at the one side of the front bobbin axis, receiving signals from the position sensors to rotate the front bobbin axis to wind the printing material.

3. The multi-purpose digital printer according to claim 1, wherein the washing means comprises:

a washing tub at the bottom of the transfer belt, receiving washing water from the outside;

a roller brush on the inside of the washing tub, adjacent to the transfer belt; and a cylinder at the bottom of the main body, lifting up and down the washing tub.

4. The multi-purpose digital printer according to claim 1, further comprising a heater at the front of the main body to dry the printing material transferred to the front bobbin axis.

5. The multi-purpose digital printer according to claim 1, further comprising an elevating cylinder on both sides of the main body respectively, and a head on the top of a piston of the elevating cylinder to adjust a gap between the transfer belt and the head unit.

6. A multipurpose digital printer comprising:

a main body with a predetermined height and width;

a head unit including a cartridge moving horizontally according to the direction of the main body, and a head at the one side of the cartridge injecting ink to print on a printing material supplied from the rear of the main body;

a transfer means including a front and a rear transfer rollers coupled with a transfer motor in the front and the rear of the main body respectively, and a track laying and adhesive transfer belt connecting the front and the rear transfer rollers making the printing material movement stable;

a rear transfer means including a rear bobbin axis installing a bobbin wired by the printing material in the rear of the main body, and multiple rear rollers at a predetermined position adjacent to the rear bobbin axis stably transferring the printing material in the forward direction;

a front transfer means at the front of the main body, winding the printing material past the transfer belt by the rear transfer means to a front bobbin axis;

a washing means eliminating the residues of the injected ink of the transfer belt and adhered foreign substances by rotation of a roller brush driven by a motor of the main body;

a belt heater at a predetermined position on the bottom of the main body eliminating moisture and maintaining the sticky state of the transfer belt passing through the washing means; and a positioning means at the rear of the main body to prevent position deviation of the printing material, wherein the positioning means includes: a left and right adjusting roller rotatable between both brackets of the main body; two rear position sensors at a predetermined position of the rear transfer means; and a cylinder receiving signals from one of the rear position sensors to lead the left and right adjusting roller to set the deviated printing material in the correct position.

* * * * *